US009270065B2

(12) United States Patent
Fang et al.

(10) Patent No.: US 9,270,065 B2
(45) Date of Patent: Feb. 23, 2016

(54) ELECTRICAL CONNECTOR WITH INTER-MOLDED TERMINALS

(71) Applicant: HON HAI PRECISION INDUSTRY CO., LTD., New Taipei (TW)

(72) Inventors: Al-Hong Fang, Kunshan (CN); I-Fan Yen, New Taipei (TW); Huo-Xing Jin, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 131 days.

(21) Appl. No.: 14/040,524

(22) Filed: Sep. 27, 2013

(65) Prior Publication Data

US 2014/0094068 A1 Apr. 3, 2014

(30) Foreign Application Priority Data

Sep. 29, 2012 (CN) ..... 2012 2 0507184 U

(51) Int. Cl.

| | |
|---|---|
| ***H01R 9/22*** | (2006.01) |
| ***H01R 24/60*** | (2011.01) |
| ***H01R 12/71*** | (2011.01) |
| ***H01R 43/24*** | (2006.01) |
| *H01R 4/02* | (2006.01) |
| *H01R 12/57* | (2011.01) |

(52) U.S. Cl.

CPC ..... *H01R 24/60* (2013.01); *H01R 12/716* (2013.01); *H01R 43/24* (2013.01); *H01R 4/028* (2013.01); *H01R 12/57* (2013.01)

(58) Field of Classification Search

CPC ..... H01R 43/24; H01R 13/405; H01R 9/24; H01R 23/7073; H01R 23/025

USPC ..... 439/74, 660, 674, 722, 736; 29/883

See application file for complete search history.

(56) References Cited

U.S. PATENT DOCUMENTS

| | | | | |
|---|---|---|---|---|
| 5,772,474 | A * | 6/1998 | Yagi et al. | 439/660 |
| 6,010,370 | A | 1/2000 | Aihara et al. | |
| 7,029,333 | B2 * | 4/2006 | Shimizu et al. | 439/660 |
| 7,985,099 | B2 * | 7/2011 | Wu | 439/626 |
| 2014/0127950 | A1 * | 5/2014 | Fang et al. | 439/676 |

FOREIGN PATENT DOCUMENTS

| | | |
|---|---|---|
| TW | M445677 | 7/2001 |

* cited by examiner

*Primary Examiner* — Vanessa Girardi

(74) *Attorney, Agent, or Firm* — Wei Te Chung; Ming Chieh Chang

(57) ABSTRACT

An electrical connector includes an insulative housing and a plurality of conductive terminals fixed in the housing, the housing includes a pair of side walls, a pair of end walls and a plug-receiving cavity with an insertion direction surrounded by an inner surfaces of the said four walls, each terminal defines a plate portion embedded in the inner surface of the side walls, and a soldering portion extends out of the housing, each plate portion defines a contacting surface facing and exposing to the plug-receiving cavity and two corners opposite to the contacting surface, the side walls of the housing define a plurality of holes through an outer surface and the holes are located between every adjacent plate portions of the conductive terminals, seen from a cross-section of the electrical connector perpendicular to the insertion direction, said two corners of each plate portion are exposed to adjacent holes.

17 Claims, 7 Drawing Sheets

ELECTRICAL CONNECTOR WITH INTER-MOLDED TERMINALS

BACKGROUND OF THE INVENTION

1. Field of the Invention

The present invention relates to an electrical connector, and more particularly to an electrical connector with a new insert-molding method for terminal retaining. This application relates to the copending application Ser. No. 13/909,111 filed Jun. 4, 2013.

2. Description of the Related Art

U.S. Pat. No. 6,010,370 issued to Molex Incorporated. on Jan. 4, 2000, discloses an electrical connector including: an insulative housing, and a plurality of conductive terminals fixed to the housing. The housing defines a pair of long walls and a pair of short walls commonly bounding a plug-receiving cavity with an insertion direction. The terminals are arranged with a predetermined distance on the side surfaces and the upper surfaces along a longitudinal direction of the housing. Each terminal defines a solder portion, a connecting portion and a base portion connecting with the solder portion and the connecting portion. Both the long walls have a plurality of rectangle grooves between every two adjacent terminals, and the connecting portions are set in the grooves. Since the grooves are rectangle-shaped, it is hard to position the terminals into the grooves before the insert-molding process and it is not benefit to demoulding.

Therefore, an improved electrical connector is desired to overcome the disadvantages of the related arts.

BRIEF SUMMARY OF THE INVENTION

An object of the present invention is to provide an electrical connector which is easier to position terminals during forming a connector by an insert-molding process.

In order to achieve above-mentioned object, an electrical connector including an insulative housing, a plurality of conductive terminals fixed to the insulative housing. The insulative housing defines a pair of long walls and a pair of short walls bounding a plug-receiving cavity with an insertion direction. A plurality of conductive terminals embedded along the long walls, the conductive terminals including plate portions embedded in the insulative housing and soldering portions extending out of the outer surfaces, the plate portions define two side edges, the holes are between every two adjacent terminals. The side edges of the plate portions are exposing in the corresponding holes.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
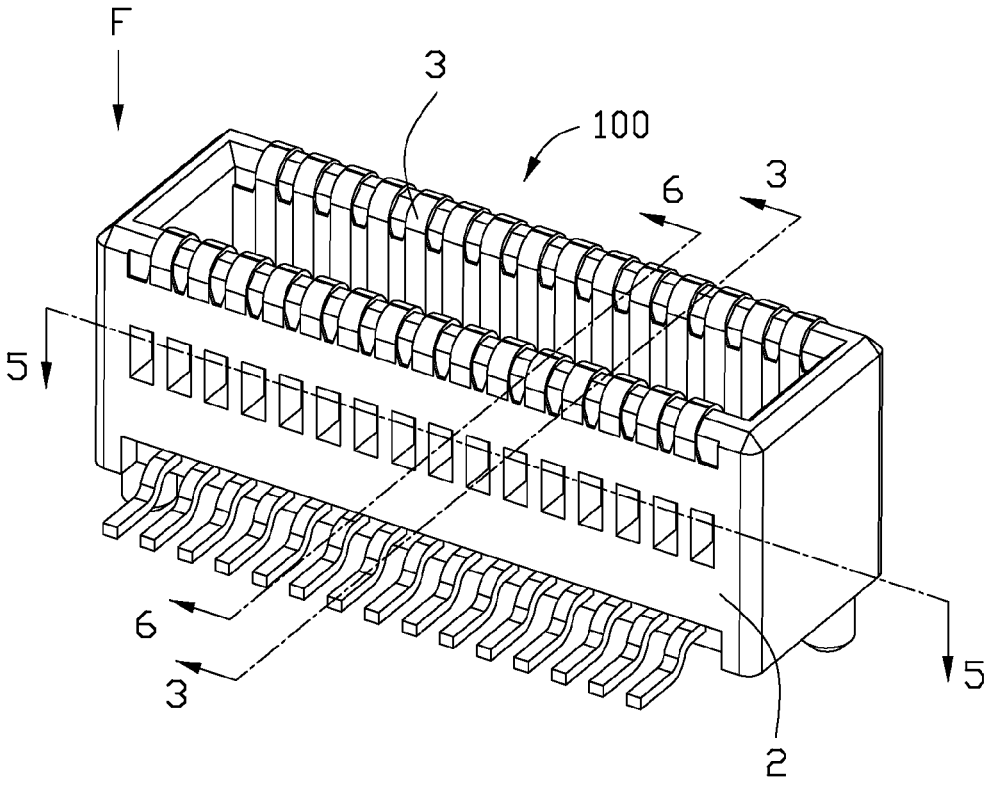
FIG. 1 is a perspective view of an electrical connector in accordance with the present invention.

Reference will now be made to the drawing figures to describe a preferred embodiment of the present invention in detail. FIG. 1 illustrates an electrical connector 100, the electrical connector 100 includes an insulative housing 2, and a plurality of conductive terminals 3 embedded in the insulative housing 2. The invention introduces a new way for the terminals' positioning, and it is easy to manufacture the electrical connector.

Figure 2:
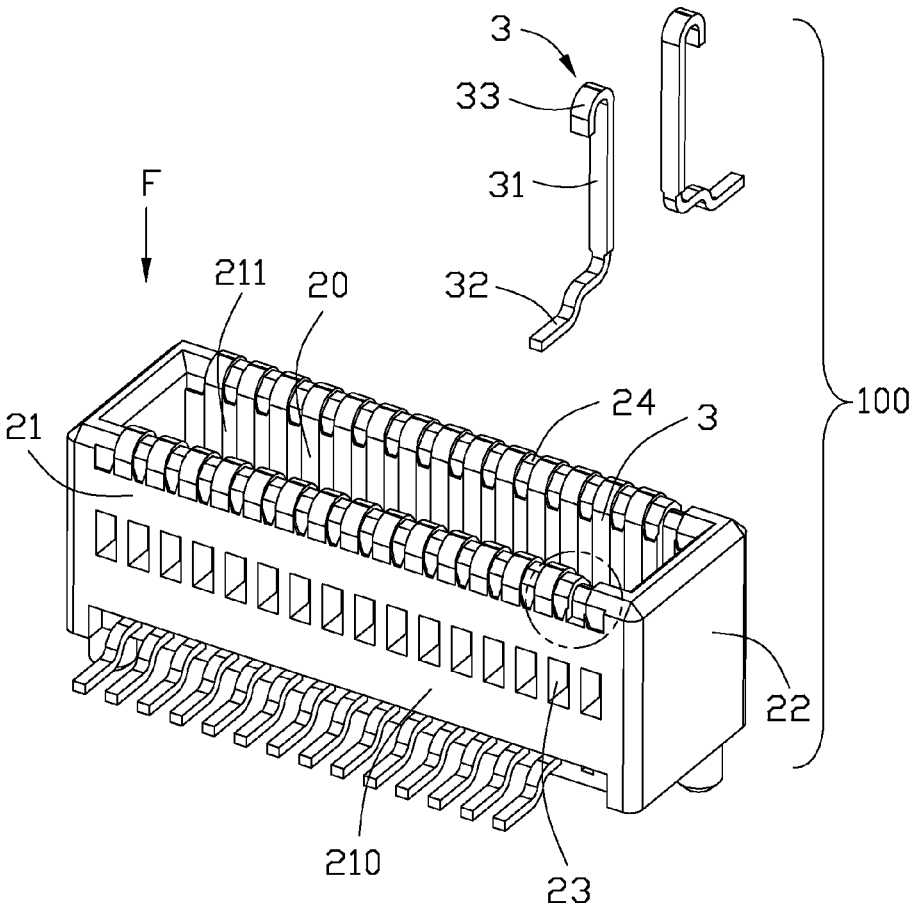
FIG. 2 is a partially exploded perspective view of the electrical connector shown in FIG. 1.
Figure 3:
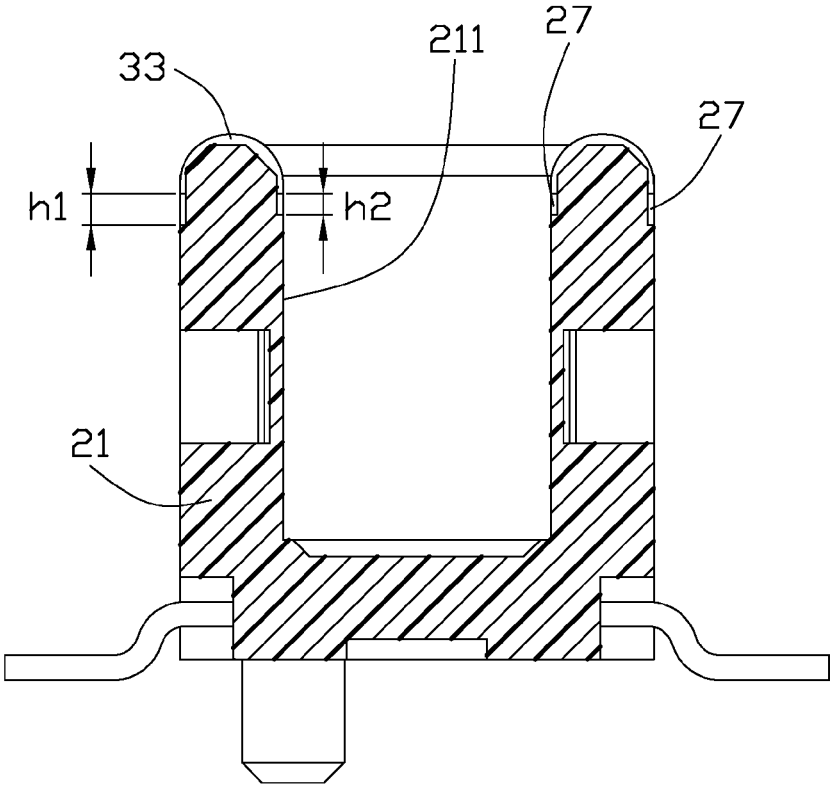
FIG. 3 is a cross-section view of the electrical connector taken along line 3-3 shown in FIG. 1.
Figure 4:
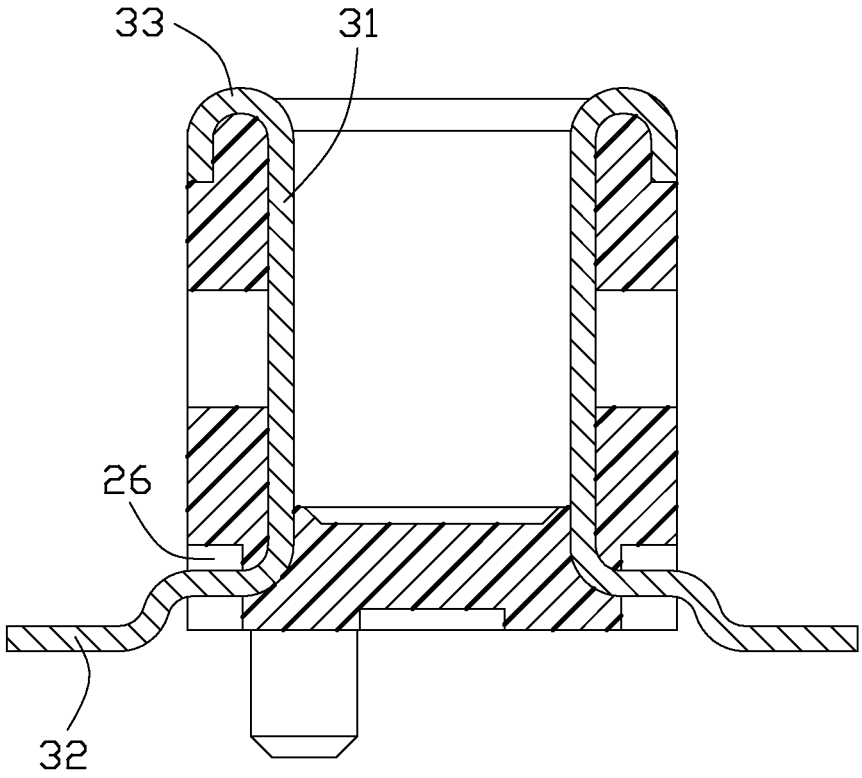
FIG. 4 is a cross sectional view of the electrical connector taken along line 4-4 shown in FIG. 1.

Referring to FIGS. 2 to 4, the insulative housing 2 is made from insulative material, such as plastic, etc., by injection molding process, and comprises a pair of side walls or long walls 21, and a pair of end walls or short walls 22 laterally connecting with the long walls 21. A plurality of holes 23 run through the outer surfaces 210 of the long walls 21, and each terminal 3 is arranged between two adjacent holes 23 along a longitudinal direction of the electrical connector.

The inner surfaces 211 of the long walls 21 and the short walls 22 define a plug-receiving cavity 20 thereamong with an insertion direction F. The terminals 3 are located in the inner surfaces 211 of the long walls 21 along the longitudinal direction. Please notes, the housing 2 is shaped by an insert-molding method. The manufacture procedure can be realized as follows. Firstly, the plurality of terminals 3 is stamped and formed with a predetermined shaped. Secondly, the terminals 3 are pre-positioned into a mold cavity and then melted insulative material is injected into the mold cavity. Finally, spare the outer mold core from the mold cavity after the terminals 3 and the insulative material are cooled down. Therefore, the electrical connector 100 is shaped. Each terminal 3 defines a plate portion 31 partially embedded into the inner surface of the long wall 21, and a soldering portion 32 extending from the lower end of the plate portion 31 and out of the housing 2. The plate portions 31 are flushed with the inner surfaces 211 of the plug-receiving cavity 20. A head portion 33 extends from the upper end of the plate portion 31, bends outwardly and downwardly to climb over the upper surface 24 of the long wall 21, and exposed upon the outer surface 210 of the long wall 21. The head portions 33 are located above the holes 23 in the insertion direction F of the electrical connector 100. The plate portions 31 of the terminals 3 are flushed with the inner surfaces 211 of the long walls 21, and two lateral edges 313 of each plate portion 31 expose in two adjacent holes 23 (as best shown in FIG. 5 and FIG. 6).

Scoop portions 26 are formed adjacent to the soldering portions 32 at the outer surfaces 210 of the long walls 21, which are formed due to extraction of the mold core. The soldering portions 32 are bended three times from the lower end of the plate portions 31. The upper parts of the soldering portions 32 are located in the scoop portions 26 and the lower parts of the soldering portions 32 are extending out of the housing 2.

Figure 5:
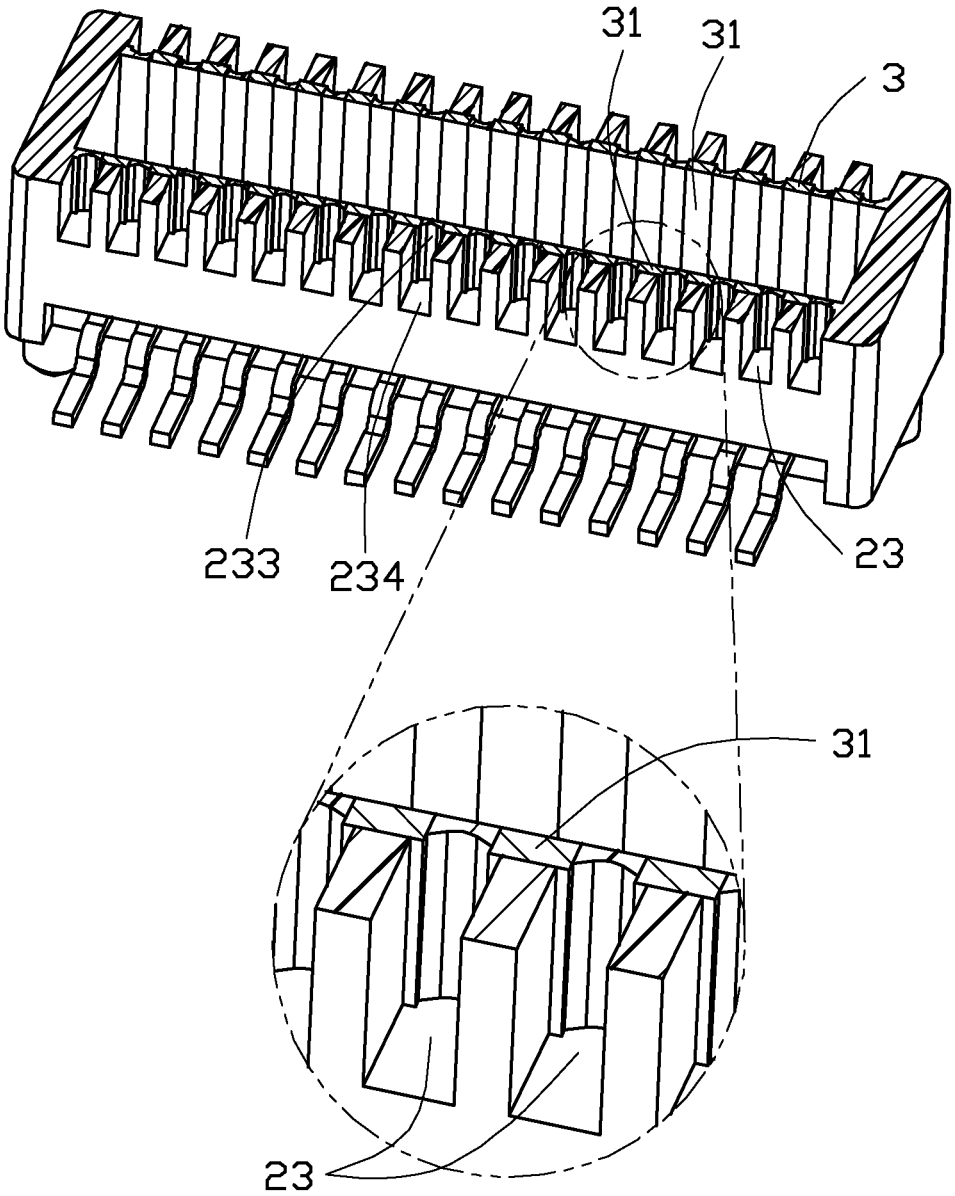
FIG. 5 is a partly perspective view of the connector, wherein an upper half part is removed along line 5-5 shown in FIG. 1.
Figure 6:
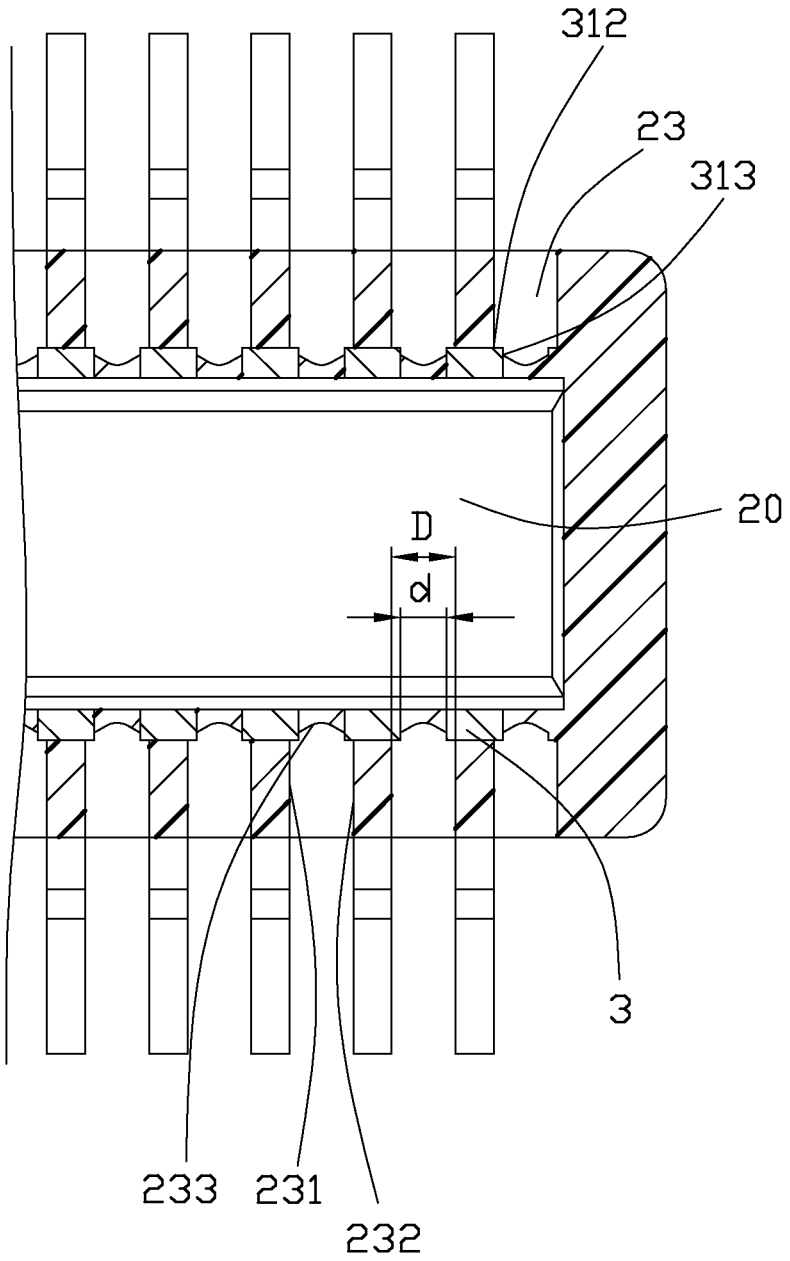
FIG. 6 is a top view of the electrical connector shown in FIG. 5.

Referring to FIG. 5 to FIG. 6, a plurality of holes 23 are recessed to the plug-receiving cavity 20. The holes 23 are formed between every two adjacent terminals 3 after the outer mold core for positioning terminals 3 is extracted away. A front edge of the plate portion 31 exposing to the mating cavity 20 is functioned as a contacting surface, the plate portion 31 further defines a rear edge 312 opposite to the contacting surface and the lateral edges 313 perpendicularly connecting with the front edge 312 and the rear edge 312. One corner of the rear edge 312 and one lateral edge 313 of the plate portion 31 are exposed in a corresponding hole 23 and another corner of the rear edge 312 and another lateral edge 313 of the plate portion 31 is exposed in an adjacent corresponding hole 23 (referring to FIG. 6). Each hole 23 defines a first or left face 232, a second or right face 231 opposite to the left face 232, an inner face 233 and a bottom 234, the inner surface 233 is connecting with the left and right faces 231, 232 which is arc-shaped or has a bulged configuration. A distance D between the left and right face 231, 232 in each hole 23 is larger than the distance d between two adjacent terminals 3. The distance between the two adjacent holes 23 is equal to the width of the terminal 3 therebetween around the plate portion, i.e., the plate portion 31 being located between the adjacent two holes each having the "d" width thereabouts. The inner face 233 in each hole 23 is disposed between two opposite lateral edges 313 of two adjacent terminals 3.

The holes 23 are formed during the procedure of the manufacture, the terminals 3 can be restricted in the longitudinal direction by protrude portions of an outer mold core corresponding to the inner face 233 abutting against the lateral edges 313, synchronously, the terminals 3 also can be restricted in a widthways direction perpendicular to the insertion direction F and the longitudinal direction by the outer mold core abutting against rear edges 312.

Figure 7:
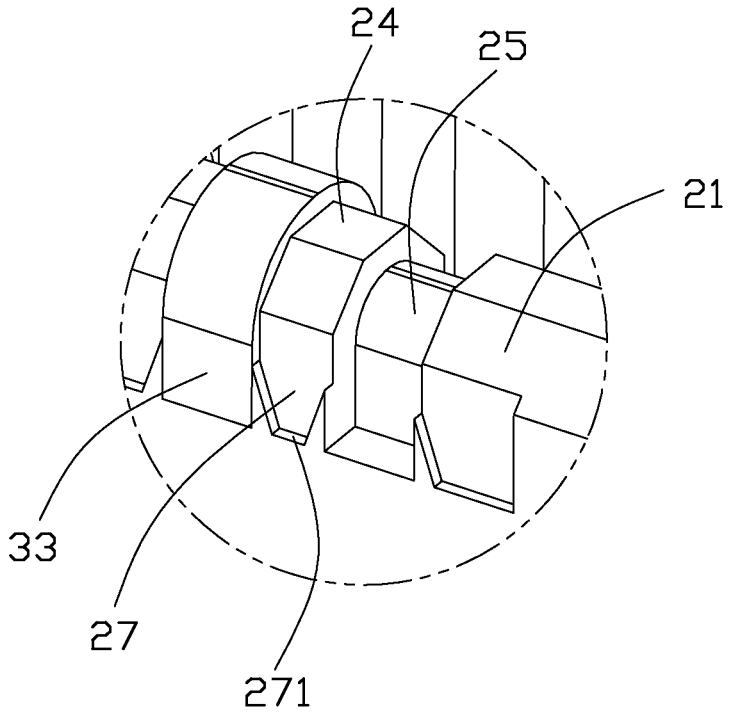
FIG. 7 is an enlarged view of a portion of the electrical connector in circle shown in FIG. 2.

Referring to FIG. 3 and FIG. 7, part of the head portion 33 of the terminal 3 is embedded into the longer walls 21, and part is protruding out of the upper surface 24 of the long wall 21. A plurality of terminal passageways 25 are left when terminals 3 are removed. Grooves 27 are left on an upper portion of the long walls 21 between every two adjacent terminal passageways 25 after outer mold core is removed away. The grooves 27 run through the upper surface 24 of the long walls 21 and define bottom surfaces 271 which are flush with the ends of the head portions 33 of the terminals 3. From the direction parallel to the short wall, the ends of grooves 27 are Ladder-shaped, the ends of terminal passageways 25 are rectangle-shaped, and the width of the bottom surface 271 is smaller than the distance between the side edges of adjacent terminals 3.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing including a pair of side walls extending along a longitudinal direction, a pair of end walls and a plug-receiving cavity surrounded by an inner surfaces of the said four walls, the plug-receiving cavity upwardly exposed to an exterior in an insertion direction perpendicular to said longitudinal direction;

a plurality of conductive terminals, each terminal defining a plate portion embedded in the inner surface of the side walls, and a soldering portion extending out of the housing, each plate portion defining a contacting surface facing and exposing to the plug-receiving cavity and two corners opposite to the contacting surface; wherein the side walls of the housing define a plurality of holes through an outer surface thereof and the holes are located between every adjacent plate portions of the conductive terminals in a horizontal cross-section of the electrical connector perpendicular to the insertion direction, said two corners of each plate portion being respectively exposed to adjacent holes in said longitudinal direction.

2. The electrical connector as described in claim 1, wherein each hole defines a left face, a right face and an inner face, a distance between the left and right face is larger than a distance between two adjacent terminals, an inner surface is recessed further than a rear edge opposite to the contacting surface of the plate portion.

3. The electrical connector as described in claim 1, wherein the inner face is connecting with the left and right faces, which is arc-shaped.

4. The electrical connector as described in claim 1, wherein a distance between the adjacent two holes is equal to a width of each terminal around the plate portion.

5. The electrical connector as described in claim 4, wherein scoop portions are formed adjacent to the soldering portions at the outer surfaces of the side walls.

6. The electrical connector as described in claim 1, wherein the plate portions extend with head portions opposite to the soldering portions, the plate portions are flushed with the inner surfaces of the plug-receiving cavity, the head portions bends outwardly and downwardly to climb over the upper surfaces of the side walls with partially embedded in the side walls and partially protrude to the outer surface of the side walls.

7. The electrical connector as described in claim 6, wherein the soldering portions are bended three times from the lower end of the plate portions.

8. The electrical connector as described in claim 1, wherein the terminals passageways and grooves are disposed along the outer surface of the side walls above the holes and run through the upper surfaces of the side walls, the head portions are embedded in the terminal passageways partially protruding out of the upper surfaces of the long walls.

9. The electrical connector as described in claim 8, wherein the grooves define bottom surfaces, the bottom surfaces are flush with the ends of the head portions of the terminals.

10. The electrical connector as described in claim 8, wherein the ends of grooves are tapered, and the ends of terminal passageways are rectangle-shaped, the width of the bottom surface is smaller than the distance between the lateral edges of two adjacent terminals.

11. An electrical connector comprising:

an insulative housing defining two opposite elongated walls each extending along a longitudinal direction, and two opposite end walls commonly defining a receiving cavity thereamong;

at least one row of contacts disposed upon at least one of said two elongated walls, respectively, each of said contacts defining a contacting section with thereon a contacting face inwardly facing the receiving cavity; and a plurality of holes formed in said at least one of said elongated walls and alternately arranged with the contacts along said longitudinal direction, each of said holes outwardly exposed to an exterior in a transverse direction perpendicular to said longitudinal direction; wherein the contacting section of each of said contacts defines a back face opposite to said contacting face, the two opposite corner sections by two sides of said back face are respectively exposed to the two corresponding neighboring holes in at least said longitudinal direction.

12. The electrical connector as claimed in claim 11, wherein each of said two opposite corner sections are exposed to the corresponding hole in both said longitudinal direction and said transverse direction.

13. The electrical connector as claimed in claim 12, wherein the back face of the contacting section of each of said contacts is hidden behind the housing except said two corner sections exposed to the two neighboring holes.

14. The electrical connector as claimed in claim 12, wherein an interior face of the elongated wall is flush with the contacting face of the contacting section of each of said contacts.

15. The electrical connector as claimed in claim 12, wherein said hole does not extend inwardly through the housing along said transverse direction so as to be isolated from the receiving cavity.

16. The electrical connector as claimed in claim 15, wherein the hole defines a bulged configuration at an inner end thereof in a horizontal cross-section.

17. An electrical connector comprising:

an insulative housing defining a plug-receiving cavity surrounding by inner surfaces of a plurality of side walls and upwardly exposed to an exterior in an insertion direction;

a plurality of terminals embedded in at least one of said side walls extending along a longitudinal direction perpendicular to said insertion direction, each terminal comprising a plate portion in said at least one of said side walls, the plate defining a contacting surface flush with the inner surface and exposing to the plug-receiving cavity in a transverse direction perpendicular to both said insertion direction and said longitudinal direction;

the at least one wall defining a plurality of holes through an outer surface of the at least one wall;

wherein the plate portion defining a rear surface opposite to the contacting surface and two side surfaces connecting with the rear surface and the contacting surface, the rear surface and the side surfaces are embedded in the at least one of said side walls except that two corners of the rear surface and the side surfaces are respectively exposed to the corresponding adjacent holes in said longitudinal direction.

* * * * *